US011437736B2

(12) United States Patent
Toprak

(10) Patent No.: US 11,437,736 B2
(45) Date of Patent: Sep. 6, 2022

(54) BROADBAND ANTENNA HAVING POLARIZATION DEPENDENT OUTPUT

(71) Applicant: Technische Universität München, Munich (DE)

(72) Inventor: Zafer Toprak, Munich (DE)

(73) Assignee: TECHNISCHE UNIVERSITÄT MÜNCHEN, Munich (DE)

( * ) Notice: Subject to any disclaimer, the term of this patent is extended or adjusted under 35 U.S.C. 154(b) by 53 days.

(21) Appl. No.: 17/264,632

(22) PCT Filed: Jul. 30, 2019

(86) PCT No.: PCT/EP2019/070428
§ 371 (c)(1),
(2) Date: Jan. 29, 2021

(87) PCT Pub. No.: WO2020/025575
PCT Pub. Date: Feb. 6, 2020

(65) Prior Publication Data

US 2021/0313710 A1 Oct. 7, 2021

(30) Foreign Application Priority Data

Aug. 1, 2018 (EP) ..... 18186785

(51) Int. Cl.
*H01Q 21/24* (2006.01)
*H01Q 21/06* (2006.01)
(Continued)

(52) U.S. Cl.
CPC ..... *H01Q 21/24* (2013.01); *H01Q 1/48* (2013.01); *H01Q 9/0407* (2013.01); *H01Q 21/062* (2013.01); *H01Q 21/065* (2013.01)

(58) Field of Classification Search
CPC .... H01Q 21/24; H01Q 21/062; H01Q 21/065; H01Q 9/0407; H01Q 9/065; H01Q 1/48
See application file for complete search history.

(56) References Cited

U.S. PATENT DOCUMENTS 9,502,780 B2 11/2016 Chau et al.
2007/0210976 A1 9/2007 Luk et al.

FOREIGN PATENT DOCUMENTS

CN 101034765 A * 9/2007 ..... H01Q 21/24
WO 2017151210 A1 9/2017

OTHER PUBLICATIONS

Hang, W., "A Novel Wideband Unidirectional Antenna", City University of Hong Kong, Nov. 2006.

(Continued)

*Primary Examiner* — Hoang V Nguyen
(74) *Attorney, Agent, or Firm* — Grossman, Tucker, Perreault & Pfleger PLLC; Steven J. Grossman

(57) ABSTRACT

An antenna comprises a ground plane, a first antenna element and a second antenna element, wherein the first antenna element and the second antenna element are arranged for emitting and/or receiving electromagnetic radiation at a design wavelength with a first polarization direction and a second polarization direction, respectively, the second polarization direction being different from the first polarization direction, wherein the first and second antenna elements each comprise pairs of resonator elements having sidewalls facing a corresponding probe arranged in each pair of resonator elements, wherein one resonator element of each pair of resonator elements is shared between the first and second antenna elements and the respective probes of the first and second antenna elements are arranged on different sides of the shared resonator element.

20 Claims, 5 Drawing Sheets

(51) Int. Cl.
*H01Q 1/48* (2006.01)
*H01Q 9/04* (2006.01)

(56) References Cited

OTHER PUBLICATIONS

Hong, W. et al., "Millimeter-Wave 5G Antennas for Smartphones Overview and Experimental Demonstration" IEEE Transactions on Antennas and Propagnation, vol. 65, No. 12, Dec. 2017.
Lei, G. et al., "Linearly Polarized and Dual-Polarized Magneto-Electric Dipole Antennas With Reconfigurable Beamwidth in the H-plane," IEEE Transactions on Antennas and Propagation, vol. 64, No. 2, Feb. 2016.

* cited by examiner

BROADBAND ANTENNA HAVING POLARIZATION DEPENDENT OUTPUT

FIELD OF THE INVENTION

The present invention is in the field of antennas. More precisely, the present invention relates to an antenna array having polarization dependent output and beam steering capabilities for possible 5G applications.

BACKGROUND

Modern information exchange is increasingly based on free space electromagnetic wave transfer between communicating parties. The growing demand for higher data transfer rates and the rising number of participants drives an ongoing development in radiofrequency technology towards higher frequencies and higher bandwidth.

Antennas are used to send and receive signals encoded in electromagnetic waves and to provide an interface between electromagnetic waves propagating in free space and on-chip electronics for information processing, such as in base stations or mobile terminals. This interface often constitutes a bottleneck for the available frequencies for data transmission.

To meet the requirements of next-generation communication standards, these antennas should feature a broad bandwidth in which they can collect and emit electromagnetic radiation. Preferably, the bandwidth of next-generation antennas should cover a large portion of the proposed bandwidth for the envisioned 5G standard spanning from 24 GHz to 43.5 GHz. Furthermore, such antennas should feature directionality as well as a selectable principal polarization direction to further increase data rates and reception quality as well as to reduce energy consumption. However, several of these requirements can be in a conflicting relationship with each other, and an antenna geometry should therefore create an advantageous compromise between these requirements by appropriate arrangement and dimensioning of antenna elements.

Lei Ge and Kwai-Man Luk ("*Linearly Polarized and Dual-Polarized Magneto-Electric Dipole Antennas With Reconfigurable Beamwidth in the H-plane*"; *IEEE Transactions on Antennas and Propagation*, Vol. 64, No. 2, February 2016) describe an antenna configuration with a square arrangement of four free-standing metallic clamps with two crossed gamma-shaped probes situated in the center of the square arrangement. Each of the crossed gamma-shaped probes is connected to a corresponding feedline to emit and receive electromagnetic waves with a given polarization at a frequency of around 2 GHz.

J. Wang et al. ("*A 60-GHz Horizontally Polarized Magneto-Electric dipole Antenna Array with Two Dimensional multi-beam End-fire Radiation*"; *IEEE Transactions on Antennas and Propagation*, Vol. 65, Issue 11, 2017) describe a polarized antenna configuration, wherein metallic patches arranged at the end of a via-defined waveguide form an end-fire ME-dipole antenna to achieve high bandwidth electromagnetic wave emission at high frequencies.

W. Hong et al. ("*Millimeter-wave 5G Antennas for Smartphones: Overview and Experimental Demonstration*"; *IEEE IEEE Transactions on Antennas and Propagation,* Vol. 65, Issue 12, 2017) describe polarized mesh grid patch antennas for use in mobile phones with a plurality of differently polarized antennas arranged at edges of a module to generate directed and polarized emission of electromagnetic wave radiation at frequencies above 24 GHz.

U.S. Pat. No. 9,502,780 B2 discloses a planar array of bowtie antennas, wherein probes are protruding from the substrate and are electrically connected to edges of diamond shaped resonators to excite a dipole bowtie antenna formed by neighboring corners of adjacent diamond shaped resonator elements.

US 2007/0210976 A1 discloses a microstrip based complementary wideband base station antenna for second and third generation radiofrequency communication. The antenna comprises electrical dipole sections composed of metallic elements arranged over a ground plane and shorted to said ground plane with vertical sections at the facing edges of the dipole sections. A gamma shaped probe may be placed between the facing metallic plates in order to couple a signal into the shorted dipole. The antenna structure can be integrally formed or assembled by attaching the dipole sections to the ground plane with screws or other fixation means via the vertical sections.

SUMMARY OF THE INVENTION

The known antenna geometries can however be difficult to fabricate, may not provide beam steering or dual-polarized operation or may suffer from high coupling between different polarization directions, low frequency, low bandwidth, or low efficiency.

The object of the invention is therefore to provide an efficient dual-polarized broadband antenna with low cross-polarization in operation, whose geometry allows scaling up for providing a phased array of emitters and which can be readily fabricated on state-of-the-art substrates.

This object is solved by an antenna and a corresponding construction method according to the independent claims. The dependent claims relate to preferred embodiments.

For clarity and brevity of discussion, for the relative arrangement of surfaces and elongated shapes, the terms "approximately parallel" and "approximately perpendicular" will be used in the following description. While in many embodiments optimal device performance can be obtained with exactly parallel and exactly perpendicular arrangements, the skilled person will appreciate that the relative arrangement may also be subject to substantial variation of the relative alignment without adversely affecting the device performance within acceptable threshold levels and may further be subject to production tolerances. In this context, the terms "approximately parallel" and "approximately perpendicular" may be understood to relate to a range of relative arrangements deviating from said exactly parallel or exactly perpendicular arrangements by less than 30°, or by less than 10°, preferably by less than 5°, respectively.

Additionally, the respective dimensions of the antennas will be described with reference to a design wavelength as an exemplary wavelength within the intended emission/reception band of the antenna. It is noted that the terms wavelength and frequency will be used interchangeably for characterizing the performance of the antenna and if not otherwise mentioned, a comparison between a spatial distance and a given wavelength should be considered to take into account the local dielectric environment. Although, for the sake of brevity, the discussion will be centered on a single design wavelength/frequency, the skilled person will appreciate that the antennas described herein may be suitable for emitting and receiving electromagnetic waves in a broad range of frequencies and wavelengths. The design wavelength/frequency may therefore be understood as a wavelength/frequency falling into the intended range of wavelengths/frequencies to be emitted/received by the antenna, such as the center wavelength/frequency in the intended range of wavelengths/frequencies or the lowest/highest wavelength/frequency in the intended range of wavelengths/frequencies. For example, the design frequency may be a frequency of the envisioned 5G standard, such as 24 GHz, or 34 GHz, or 44 GHz.

The intended range of wavelengths/frequencies may correspond to an intended frequency band, such as a continuous or discontinuous interval of frequencies, wherein said interval of frequencies may be characterized by the antenna fulfilling a certain requirement within said interval of frequencies. For example, the antenna requirement may postulate that a realized gain of the radiated intensity of the antenna is above a certain threshold value or may postulate that an S-parameter of the antenna is above or below a given threshold value, such as an upper threshold value for an S11 parameter of the antenna, or any combination thereof.

Further, reference will be made to the "cross-polarization" and "co-polarization" of the antenna, which may specify the purity of the polarization of the electromagnetic radiation emitted or received by an element of the antenna, said element being intended to primarily emit or receive electromagnetic radiation with a first polarization direction. In this context, co-polarization may relate to the relative magnitude of electromagnetic radiation having the first polarization direction, which is emitted by said element of the antenna as compared to an isotropic emitter emitting the same effective power and at a given detector position. The cross-polarization may relate to the relative magnitude of electromagnetic radiation emitted by said element of the antenna having a second polarization direction, which is perpendicular to the first polarization, as compared to an isotropic emitter emitting the same effective power and at the given detector position.

According to a first aspect, the invention relates to an antenna comprising a ground plane, a first antenna element and a second antenna element. The first antenna element is arranged for emitting and/or receiving electromagnetic radiation with a first polarization direction at a design wavelength. The first antenna element comprises a first probe, the first probe extending through the ground plane and being electrically isolated from the ground plane and a first resonator. The first resonator comprises a first resonator element and a second resonator element. The first resonator element and the second resonator element are each coupled to the ground plane and each have a vertical sidewall facing the first probe, the vertical sidewall being approximately perpendicular to the ground plane. The vertical sidewalls of the first and second resonator elements, which are facing the first probe, are spaced by a first distance along a first direction and form a first cavity. The first probe is arranged at least partially in the first cavity between the first resonator element and the second resonator element. The second antenna element is arranged for emitting and/or receiving electromagnetic radiation with a second polarization direction at the design wavelength, the second polarization direction being different from the first polarization direction. The second antenna element comprises a second probe, the second probe extending through the ground plane and being electrically isolated from the ground plane, and a second resonator. The second resonator comprises the first resonator element and a third resonator element coupled to the ground plane, wherein the first and third resonator elements each have a vertical sidewall facing the second probe, the vertical sidewall being approximately perpendicular to the ground plane. The vertical sidewalls of the first and third resonator elements, which are facing the second probe, are spaced by a second distance along a second direction and form a cavity, the second direction being different from the first direction. The second probe is arranged at least partially in the second cavity between the first resonator element and the third resonator element.

The first and second antenna elements share a common first resonator element which can allow forming a dense antenna array having resonator elements arranged in rows and columns. The shared resonator element between the first and second antenna elements may reduce the spatial footprint of the antenna elements when arranged in the array. Arranging the first and second probes on different sides of the first resonator elements may reduce a cross-polarization property of the antenna.

The vertical sidewalls of the resonator elements may present a conducting surface, which in combination with the ground plane implements a radiating antenna element, wherein the term vertical sidewall should not be understood as being limited to a continuous surface. Rather, the sidewalls may consist of several conductive elements spaced apart from each other and/or may feature a plurality of holes or slits while still substantially acting as a conductive wall within a given frequency range and for a given polarization direction. For example, the sidewalls may be formed by a plurality of conductive elongated pillars protruding from the ground plane.

The probe may couple with the ground plane and the resonator elements such that electromagnetic radiation may be radiated from the antenna. Specifically, the probe is arranged in and may couple to the conductive elements of a cavity between adjacent resonator elements thereby forming a radiating ME-dipole antenna, the dipole antenna emitting electromagnetic radiation with a main polarization direction coinciding with the cavity extension direction, i.e. the direction along which the resonator elements forming the cavity are spaced apart. The first/second probe may be electrically isolated from the vertical sidewalls of the first and second/third resonator elements.

In a preferred embodiment, the first probe, the first resonator element and the second resonator element are arranged with the ground plane such as to implement a shorted quarter-wave patch antenna, wherein a height of the first resonator element and/or the second resonator element is in particular selected such that the height corresponds to a quarter of the design wavelength.

Quarter-wave patches for the quarter-wave patch antenna may be provided by the sidewalls of the first and second resonator elements, which can be shorted by the ground plane to implement the shorted quarter-wave patch antenna. The shorted quarter-wave patch antenna may provide polarized and substantially uniform electromagnetic wave radiation at the design wavelength. For the height of the first and/or second resonator elements, the design wavelength may be the center frequency of the intended frequency band of the antenna or may correspond to an intermediate frequency, said intermediate frequency being higher than the center frequency of the design frequency band and smaller than the highest frequency of the design frequency band.

In another preferred embodiment, the first probe extends along the first direction in the first cavity. In some embodiments, the second probe extends along the second direction in the second cavity.

The extension of the first probe along the first or second direction in the first or second cavity may improve a coupling between the probes and the resonator elements in the respective cavity and/or may improve a co-polarization of the radiation.

In some embodiments a top portion of the first probe extends along the first direction in the first cavity and/or a top portion of the second probe extends along the second direction in the second cavity, wherein the top portion is approximately parallel to the ground plane and is spaced from the ground plane by a certain distance, which may be approximately one quarter of the design wavelength, such as the wavelength corresponding to the center frequency of the intended frequency band.

In preferred embodiments, the first and/or second probe is coupled to a feed line and comprises a gamma-shaped probe section. The gamma-shaped probe section comprises a feed portion extending through the ground plane and coupling the gamma-shaped probe section and the feed line, a top beam, the top beam being arranged approximately parallel to the first or second direction of the first or second cavity, and a probe tip, the probe tip being connected to the top beam and extending towards the ground plane, wherein the top beam connects the feed portion and the probe tip.

The gamma-shaped probe section may interact with the resonator elements to form an antenna element having low back-radiation and low cross-polarization.

In preferred embodiments, the antenna comprises a substrate, wherein the ground plane is arranged at one side of the substrate and the top beam is arranged at an opposite side of the substrate. In some embodiments, the substrate is a multilayered substrate, and the probe tip may protrude from the top beam into the multilayered substrate towards a bonding layer between two substrates of the multilayered substrate.

In some embodiments, each of the vertical sidewalls of the first and second resonator elements facing the first probe is approximately perpendicular to the first direction. In some embodiments, each of the vertical sidewalls of the first and third resonator elements facing the second probe is approximately perpendicular to the second direction.

Providing resonator elements with sidewalls having at least a portion facing the first or second probe and being approximately perpendicular to the first or second direction, respectively, may improve a stability of the antenna properties in view of production tolerances, such as an inadvertent offset of the first or second probe from the intended position, and may reduce a cross-polarization of the antenna.

In preferred embodiments, the first and/or second and/or third resonator element comprises a roof surface, the roof surface extending parallel to ground plane and being spaced from the ground plane by a roof distance, wherein said roof distance of the first resonator element and/or the second resonator element is in particular selected such that the height of the first resonator element and/or the second resonator element corresponds to a quarter of the design wavelength.

The roof surfaces of the resonator elements arranged on opposite sides of the first or second cavities may provide electrical dipoles coupling with the first or second probes such as to increase a bandwidth of the first or second antenna elements.

In some embodiments, the antenna may provide a first resonance frequency being strongly affected by the spacing of the first and/or second and/or third resonator elements from the ground plane and a second resonance frequency being strongly affected by the spatial extent of the roof surface extending approximately parallel to the ground plane.

The spatial extent of the roof surface, the spacing of the roof surface from the ground plane and the shape of the probe may be adapted to provide a set of resonating structures providing overlapping resonances for forming a broad intended frequency band.

The roof surfaces may have a mostly polygonal or mostly square shape, such as a polygonal or square shape with rounded or cut corners. In some embodiments, the resonator elements roughly have the shape of a mathematical cylinder protruding from the ground plane, wherein the roof surface is the base of the mathematical cylinder and the side surfaces of the mathematical cylinder may be related to the vertical sidewalls.

In preferred embodiments, the roof surfaces have a mostly square shape, wherein the sides of the mostly square shapes are aligned with the vertical sidewalls of the resonator elements and/or wherein the sides of the mostly square roof surface close to the first and/or second cavity are aligned perpendicular to the first and/or second direction, respectively, and may be aligned parallel to the second and/or first direction, respectively.

In preferred embodiments, the ground plane is arranged on a substrate, and the vertical sidewall of the first and/or second and/or third resonator element is formed by a plurality of vias extending through the substrate, the vias being approximately perpendicular to the ground plane, wherein adjacent vias are spaced by less than one eighth of the design wavelength.

Closely spaced vias may provide effective sidewalls for the resonator and may be easily fabricated e.g. by drilling holes in the substrate followed by metallization of the holes.

In some embodiments, adjacent vias are spaced by less than one eighth or one tenth of a lowest intended wavelength, wherein said lowest intended wavelength may correspond to a highest frequency value of the intended frequency band of the antenna. In this way, the vias may form an effective wall for electromagnetic radiation in the frequency band, such that a performance of the antenna may be increased.

In preferred embodiments, the vias form an outer wall surrounding a confined space of the first and/or second resonator element, the confined space being defined by a roof surface of the resonator element and the vias. In some embodiments, the vias are arranged close to edges of the roof surface and/or are spaced inwardly from the edges of the roof surfaces by a production margin, the production margin guaranteeing that the via hole is surrounded by a conductive portion of the roof surfaces in view of a given production tolerance for the derivation of the position of the via hole.

The outer wall surrounding the confined space may allow arranging probes on several sides of the resonator elements for forming an array of antenna elements and may further reduce a coupling between different probes.

In preferred embodiments, the antenna comprises a plurality of resonator elements, the resonator elements being arranged in rows and columns along the first and second directions, respectively.

Said arrangement of resonator elements in rows and columns may constitute an array for arranging probes, such as the first and second probes, between adjacent resonator elements of the plurality of resonator elements for providing an array of antenna elements for emitting electromagnetic radiation along the first and/or second polarization direction.

In preferred embodiments, the antenna further comprises a third antenna element. The third antenna element comprises a third probe, the third probe extending through the ground plane and being electrically isolated from the ground plane, and a third resonator, the third resonator comprising a fourth resonator element and the second resonator element. The fourth resonator element and the second resonator element are each coupled to the ground plane and each have a vertical sidewall, the vertical sidewall being approximately perpendicular to the ground plane. The vertical sidewalls of the second and fourth resonator elements, which are facing the third probe, are spaced by the first distance along the first direction and form a third cavity, and the probe is arranged at least partially between the fourth resonator element and the second resonator element. The third antenna element is arranged for emitting and/or receiving electromagnetic radiation along the first polarization direction at the design wavelength. The third probe is arranged at least partially in the third cavity between the second resonator element and the fourth resonator element.

In preferred embodiments, the first probe and the third probe are spaced by a distance, which is smaller than one half of the design wavelength in vacuum.

In some embodiments, said distance is smaller than one half of the smallest intended wavelength of the antenna in vacuum, wherein said smallest intended wavelength in vacuum corresponds to the speed of light divided by the highest frequency of the intended frequency band of the antenna.

Said distance of the first and third probes may allow implementing beam steering of the antenna radiation with a phased array of emitters. Particularly, an array of emitters according to this arrangement may allow controlling the solid angle associated with a maximum of the realized gain of the antenna about the surface normal of the ground plane by an angle of up to 90° by controlling the phase/delay of the signal fed to each probe in the array of emitters. Said distance may suppress grating lobes in the emission spectrum of the antenna and thereby improve the directionality of the antenna.

In a second aspect, the invention relates to a method for manufacturing an antenna. The method comprises providing a ground plane and manufacturing a first and a second antenna element. The first antenna element is arranged for emitting and/or receiving electromagnetic radiation with a first polarization direction at a design wavelength. Manufacturing the first antenna element comprises arranging a first probe, the first probe extending through the ground plane and being electrically isolated from the ground plane, and manufacturing a first resonator, the first resonator comprising a first resonator element and a second resonator element. The first resonator element and the second resonator element are each coupled to the ground plane and each have a vertical sidewall facing the first probe, the vertical sidewall being approximately perpendicular to the ground plane. The vertical sidewalls of the first and second resonator elements, which are facing the first probe, are spaced by a first distance along a first direction and form a first cavity, and the first probe is arranged at least partially in the first cavity between the first resonator element and the second resonator element. The second antenna element is arranged for emitting and/or receiving electromagnetic radiation with a second polarization direction at the design wavelength, the second polarization direction being different from the first polarization direction. Manufacturing the second antenna element comprises arranging a second probe, the second probe extending through the ground plane and being electrically isolated from the ground plane, and manufacturing a second resonator, the second resonator comprising the first resonator element and a third resonator element coupled to the ground plane. The first and third resonator elements each have a vertical sidewall facing the second probe, the vertical sidewall being approximately perpendicular to the ground plane. The vertical sidewalls of the first and third resonator elements, which are facing the second probe, are spaced by a second distance along a second direction and form a cavity, the second direction being different from the first direction, and the second probe is arranged at least partially in the second cavity between the first resonator element and the third resonator element.

In some embodiments, the method further comprises manufacturing, implementing or providing features of any of the embodiments of the antenna according to the first aspect.

In some embodiments, the method further comprises manufacturing a plurality of resonator elements arranged in rows and columns along the first and second directions, respectively, and arranging two probes on opposite sides of a common resonator element of the plurality of resonator elements, wherein the two probes are spaced by less than one half of the design wavelength or half of the wavelength of the highest frequency of the intended frequency band in vacuum along the first direction and/or second direction.

In some embodiments, the method further comprises providing a substrate with a ground plane, wherein manufacturing the first, second and/or third resonator elements comprises: arranging a metallic patch on a surface of the substrate, said surface being spaced from the ground plane by one quarter of the design wavelength, and connecting the metallic patch with metallic vias to the ground plane, said vias extending through the substrate, such that the metallic vias form vertical sidewalls of the respective resonator element, wherein adjacent vias are spaced by less than one eighth of the design wavelength.

In some embodiments, an array of resonator elements may be provided by arranging a plurality of metallic patches on the surface of the substrate in rows and columns and subsequently connecting the metallic patches with metallic vias to the ground plane, said vias extending through the substrate, such that the metallic vias sidewalls of the respective resonator elements.

In some embodiments, the metallic vias form outer walls of a confined space defined by the vias and the metallic patches.

In a preferred embodiment, arranging the first and/or second probes comprises forming a gamma-shaped probe. The forming of the gamma-shaped probe comprises arranging a metallic strip on the substrate, the metallic strip being arranged between adjacent metallic patches of the first, second and/or third resonator elements, such that the metallic strip is aligned with and/or close to a connecting line connecting the centers of the adjacent metallic patches, wherein a distance between the metallic strips and the ground plane is equal to or smaller than a distance between the metallic patches and the ground plane, forming a feeding via at a first end of each metallic strip, the feeding via extending through the substrate and the ground plane, and forming a tip via at a second end of each metallic strip, the second end being opposite the first end, wherein the tip via protrudes into the substrate and does not extend through the ground plane.

In some embodiments, manufacturing the antenna comprises forming a plurality of probes between neighboring resonator elements for manufacturing an array of antenna elements arranged in rows and columns, wherein the antenna elements are arranged along the first or second direction.

DETAILED DESCRIPTION OF EMBODIMENTS

The features and numerous advantages of the antenna according to the present invention will best be understood from a detailed description of preferred embodiments with reference to the accompanying drawings, in which.

Figure 1:
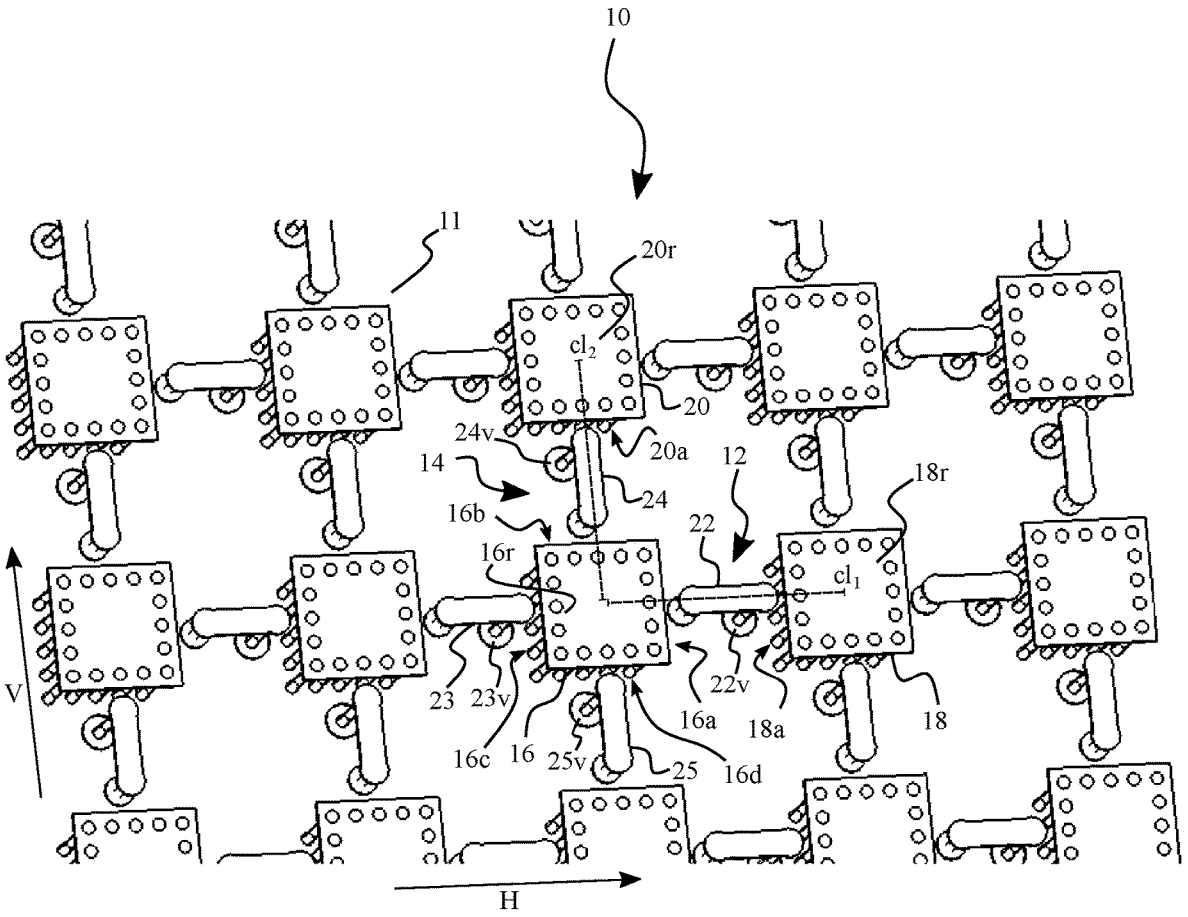
FIG. 1 is a schematic perspective view of an antenna according to an example.

FIG. 1 shows an antenna 10 with a plurality of antenna elements, including first and second antenna elements 12, 14, arranged for emitting and/or receiving electromagnetic radiation along a first and a second polarization direction, the first and second polarization directions being related to the horizontal direction H and the vertical direction V of the antenna 10. The antenna 10 comprises a ground plane 11 on which a plurality of resonator elements 16, 18, 20 are arranged, wherein between adjacent resonator elements, including a first, a second and the third resonator element 16, 18, and 20, probes 22-25 are situated to form the antenna elements 12, 14. The probes 22-25 are electrically isolated from the ground plane 11 and extend through via openings 22*v*-25*v* in the ground plane 11.

The resonator elements 16, 18, 20 comprise square roof surfaces 16*r*, 18*r*, tor, which are connected to the ground plane 11 with a plurality of metallic vias, the metallic vias forming vertical sidewalls 16*a*, 16*b*, 16*c*, 16*d*, 18*a*, 20*a* of the respective resonator elements 16, 18, 20. The vertical sidewalls 16*a*, 16*b*, 16*c*, 16*d*, 18*a*, 20*a* of the resonator elements 16, 18, 20 face probes 22-25 arranged on the corresponding sides of the resonator elements 16, 18, 20. As can be seen in FIG. 1, on each of the four sides of the resonator element 16, one probe 22-25 is arranged which is faced by the respective sidewall 16*a*, 16*b*, 16*c*, 16*d* formed by the vias of the resonator element 16, wherein each of said probes 22-25 extends approximately perpendicular to the respective adjacent sidewall 16*a*, 16*b*, 16*c*, 16*d*, i.e. the probe 22 is faced by the vertical sidewall 16*a*, the probe 24 is faced by the vertical sidewall 16*b*, the probe 23 is faced by the vertical sidewall 16*c*, and the probe 25 is faced by the vertical sidewall 16*d*.

A first antenna element 12 comprises a first probe 22 which is arranged between the first resonator element 16 and the second resonator element 18 close to a first connecting line $cl_1$ connecting the centers of the first and second resonator elements 16, 18. The first and second 3*o* resonator elements 16, 18 comprise respective vertical sidewalls 16*a*, 18*a* which are facing the first probe 22 and form a first cavity of the first antenna element 12. The first probe 22 is aligned with the first connecting line $cl_1$ between the first and second resonator elements 16, 18 along the horizontal direction H, the first antenna element 12 therefore being primarily oriented along the horizontal direction H.

A second antenna element 14 comprises a second probe 24 which is arranged between the first resonator element 16 and the third resonator element 20 close to a second connecting line $cl_2$ connecting the centers of the first and third resonator elements 16, 20. The first and third resonator elements 16, 20 comprise respective vertical sidewalls 16*b*, 20*a* which are facing the second probe 24 and form a second cavity of the second antenna element 14. The second probe 24 is aligned with the second connecting line $cl_2$ between the first and third resonator elements 16, 20 along the vertical direction V, the second antenna element 12 therefore being primarily oriented along the vertical direction V.

The ground plane 11, the first resonator element 16 and the second resonator element 18 may form a first resonator of the first antenna element 12 coupled to the first probe 22, such that an electrical excitation of the first probe 12 may induce a change in the charge distribution in the first resonator. Said change in the charge distribution in the first resonator can implement a radiating dipole for coupling an electrical excitation of the first probe 22 into a free space propagating electromagnetic wave or vice versa. The first antenna element 12 may provide a dipole mainly oriented along the horizontal direction H, such that a polarization of emitted or received radiation can be mainly polarized along the horizontal direction H.

Similarly, the ground plane 11, the first and the third resonator elements 16, 20 may form a second resonator of the second antenna element 14 coupled to the second probe 24. Since the second antenna element 14 is mainly oriented along the vertical direction V, a polarization of the emitted or received radiation of the second antenna element 14 can be mainly polarized along the vertical direction V.

In FIG. 1, the first distance along the horizontal direction H between the vertical sidewalls 16*a*, 18*a* of the resonator elements 16, 18 of the first antenna element 12 is depicted to be equal to the second distance along the vertical direction V between the vertical sidewalls 16*b*, 20*a* of the resonator elements 16, 20 of the second antenna element 14, such as to illustrate an example, wherein the intended frequency bands of the first and second antenna elements 12, 14 coincide.

Figure 2:
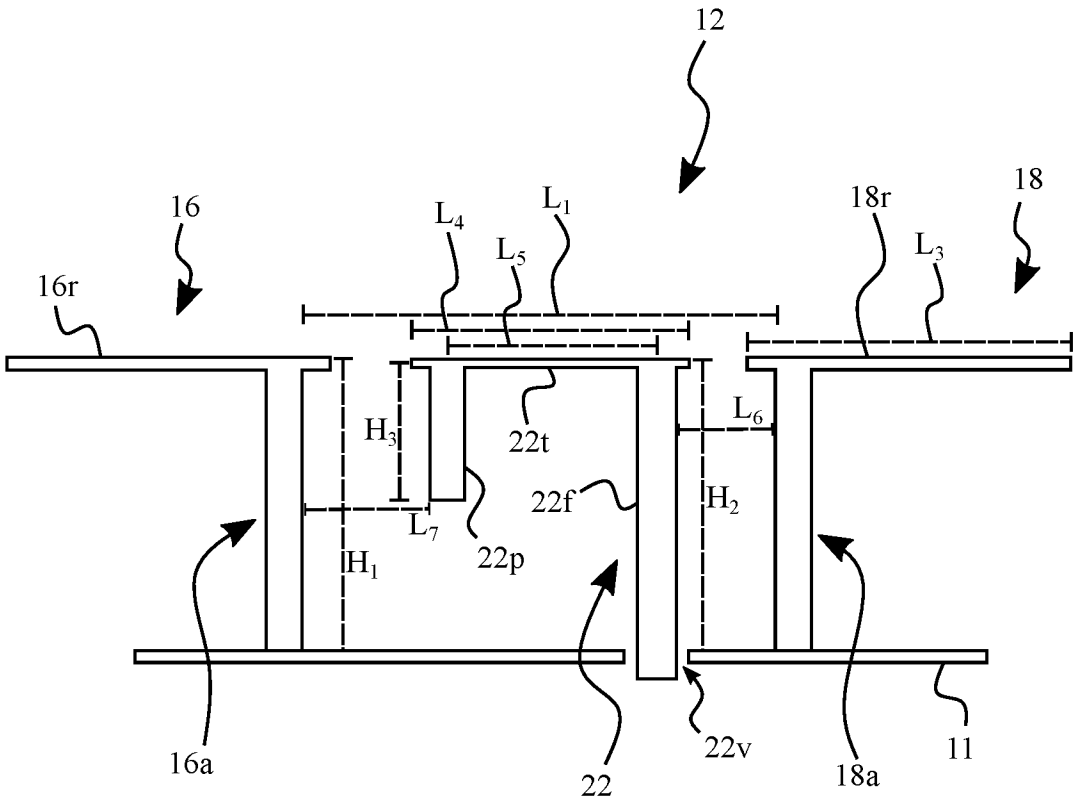
FIG. 2 is a schematic side view of an antenna according to an example.

FIG. 2 shows a schematic side view of a first antenna element 12 according to an example. The antenna element 12 is formed by a ground plane 11, two neighboring resonator elements 16, 18 and a first probe 22.

The resonator elements 16, 18 each comprise a roof surface 16*r*, 18*r* as well as vertical sidewalls 16*a*, 18*a* connecting the roof surfaces 16*r*, 18*r* to the ground plane 11. The ground plane 11 and the vertical sidewalls 16*a*, 18*a* can be considered to form a shorted patch antenna with a characteristic distance of the shorted patch antenna corresponding to a first height H1, the first height H1 corresponding substantially to the height of the vertical sidewalls 16*a*, 18*a*. The first and second resonator elements 16, 18 of the first antenna element 12 are spaced by a first distance L1 and each have roof surfaces 16*r*, 18*r* extending approximately parallel to the ground plane 11 by a third distance L3.

The resonator elements 16, 18 and the ground plane 11, to which they are connected by the sidewalls 16*a*, 18*a* can implement a shorted quarter wave patch antenna. The height H1 of the resonator elements 16, 18, by which the roof surfaces 16*r*, 18*r* are spaced from the ground plane 11, should then correspond to one quarter of the design wavelength of the antenna 10. The shorted quarter wave patch antenna can provide an ME-dipole. Hence, the antenna element 12 comprising the probe 22 arranged between the resonator elements 16, 18 and above the ground plane 11 may transform a signal fed to the probe 22 into a free space propagating electromagnetic wave at or close to the design wavelength/frequency.

In some embodiments, the third distance L3 is greater or smaller than the first distance L1 and/or the first height H1. When the third distance L3 is different from the first distance L1 and/or the first height H1, a dipole associated with the third distance L3 may provide a resonance frequency which is different from a resonance frequency associated with the first height H1 and/or the first distance L1, such as to improve the bandwidth of the antenna 10. When the third distance L3 is greater than the first distance L1 and/or the first height H1, a coupling between adjacent antenna elements 12, 14 can also be reduced.

In some embodiments, the third distance L3 is different from the first distance L1 and/or the first height H1 and deviates from the first distance L1 and/or the first height H1 by less than 50%. In some embodiments, the first distance L1 is greater than the first height H1 and deviates from the first height H1 by less than 50%, in particular by less than 30%, and the third distance L3 is greater than the first distance L1 and deviates from the first distance L1 by less than 50%, in particular by less than 30%.

The first probe 22 is provided with a gamma-shaped section and comprises a feed portion 22*f* extending through a via opening 22*v* and being approximately perpendicular to the ground plane 11. The feed portion 22*f* is arranged in the via opening 22*v*, such that the first probe 22 is electrically isolated from the ground plane 11.

The feed portion 22*f* of the first probe 22 is further connected to a top beam 22*t* extending approximately parallel to the ground plane 11 and being spaced from the ground plane 11 by a second height H2. The second height H2 may be similar to the first height H1 to improve a coupling to the ME-dipole implemented by the resonator elements 16, 18 and the ground plane 11. The top beam 22*t* extends between the first resonator 16 and the second resonator 18 over a length corresponding to a fourth distance L4.

The top beam 22*t* connects to the probe tip 22*p*, the probe tip 22*p* extending from the top beam 22*t* towards the ground plane 11 by a third height H3. The third height H3 should be smaller than the second height H2, such as close to one half of the second height H2 and/or close to one half of the first height H1. The probe tip 22*p* and the feed portion 22*f* are approximately parallel and are spaced by a fifth distance L5, wherein the fifth distance L5 should be smaller than the fourth distance L4. The fourth distance L4 should be smaller than the first distance L1, such as to accommodate the probe 22 between the first and second resonator elements 16, 18.

In some embodiments, the fourth distance L4 is different from the first height H1 or the second height H2. When the fourth distance L4 is different from the first height H1 and/or the second height H2, a bandwidth of the antenna 10 may be increased. In some embodiments, the fourth distance L4 deviates from the first height H1 or the second height H2 by less than 50%, in particular by less than 30%, preferably by less than 20%. In some embodiments, the fourth distance L4 is greater than the first height H1.

In some embodiments, the fourth distance L4 corresponds to one quarter of the wavelength associated with the center frequency of the intended frequency band or deviates from said wavelength associated with the center frequency by less than 30%, in particular less than 20%, preferably less than 10%.

In some embodiments, the first distance L1 is greater than the first height H1 and/or the second height H2, such as to arrange the probe 22 between the resonator elements 16, 18 having a fourth distance L4 which is similar to or greater than the first height H1 and/or the second height H2.

As can be seen in FIG. 2, the feed portion 22*f* of the first probe 22 may be spaced from a facing vertical sidewall 18*a* of the second resonator element 18, which is adjacent to the feed portion 22*f*, by a sixth distance L6. Said sixth distance L6 may be smaller than a seventh distance L7 between the probe tip 22*p* of the first probe 22 and the vertical sidewall 16*a* of the first resonator element 16.

In some embodiments, the sixth distance L6 and/or the radius of the feed portion 22*f* is selected, such that an impedance of the feed portion 22*f* and the vertical sidewall 18*a* is close to a desired value for impedance matching of the antenna element 12 to external circuitry, such as 50Ω or 75Ω.

The feed portion 22*f* of the probe 22 may be connected to a feed line (not shown) on an opposite side of the ground plane 11 to feed a signal to the probe 22, which can be emitted by the antenna element 12, wherein the opposite side of the ground plane 11 is opposite to the side of the ground plane 11 on which the resonator elements 16, 18, 20 are arranged.

The lengths L1-L6 and heights H1-H3 may be chosen by selecting a design frequency of the antenna 10, which may be a frequency above the center frequency of the intended frequency band of the antenna 10. The first height H1 may be selected to correspond to one quarter of the wavelength associated with said selected design frequency in the dielectric medium within which said antenna 10 is placed and/or formed.

The first distance L1 by which adjacent resonator elements 16, 18 are spaced may be selected to be greater than the first height H1, said first distance L1 deviating from the first height H1 by less than 50%. Subsequently, the third distance L3 may be selected such as to provide an antenna 10 emitting electromagnetic waves within the intended frequency band of the antenna 10 according to a given antenna requirement. To that effect, the third distance L3 may be greater than the first distance L1 and/or greater than the first height H1. The arrangement of the probe 22 between the resonator elements 16, 18 and the shape of the probe 22, and in particular a shape of the top beam 22*t* of the probe 22, may be adjusted while varying the first height H1 and the third distance L3, such as to fulfill the antenna requirement within the intended frequency band.

The second distance by which adjacent resonator elements 16, 20 are spaced may be selected to be equal or similar to the first distance L1, such as to produce similar frequency dependence of the antenna characteristics along the first and second polarization directions of the antenna 10.

Figure 3:
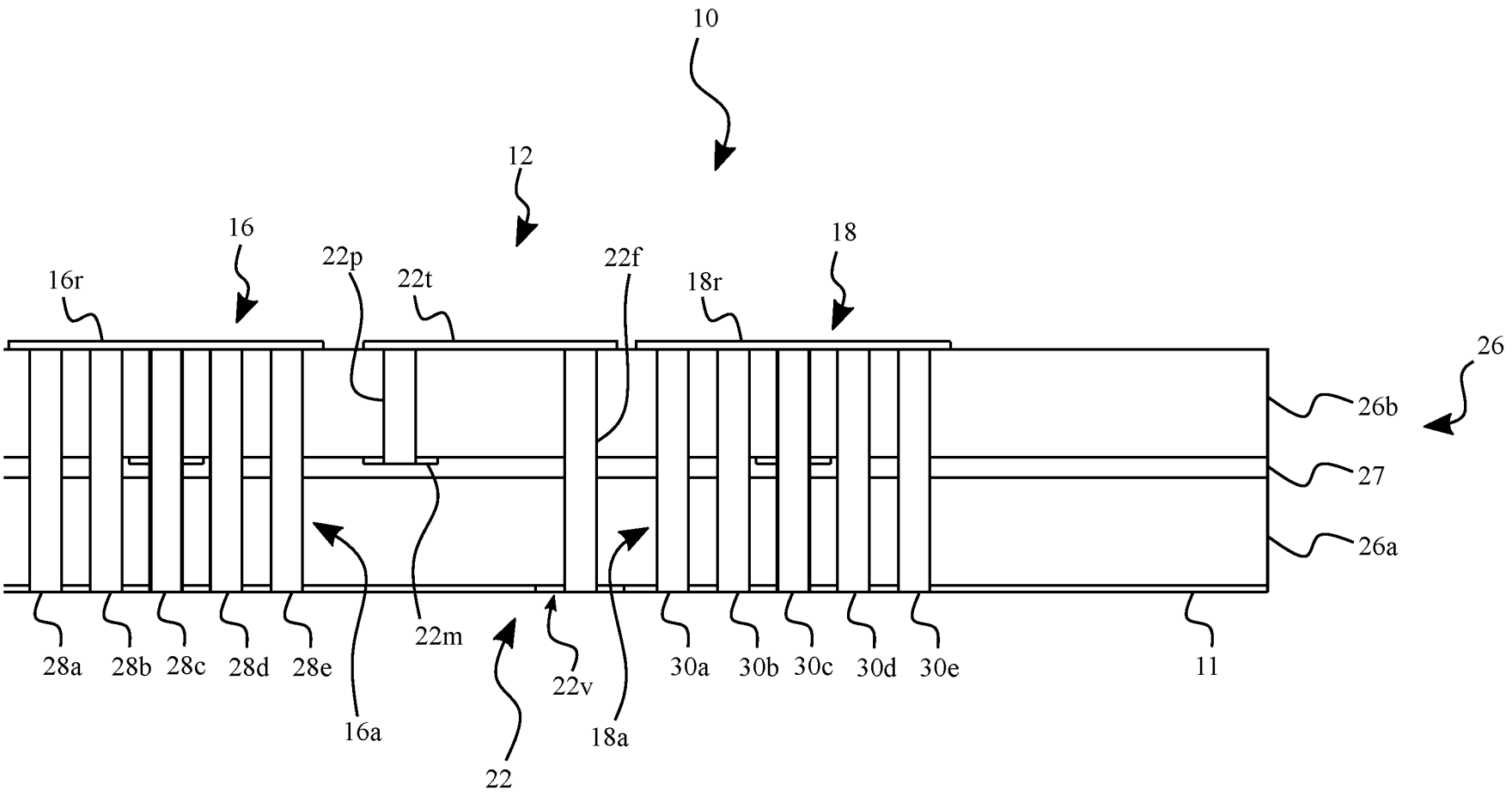
FIG. 3 is a schematic illustration of an antenna element fabricated in a substrate according to an example.

The antenna 10 may be implemented in a substrate 26 as shown in FIG. 3. The substrate 26 can be a multilayered substrate 26 comprising the first substrate element 26*a* which may be bonded to a second substrate element 26*b* through a bonding layer 27. The substrate 26 may comprise a first surface covered at least partially by the ground plane 11, and a second surface opposite to the first surface comprising metallized areas for the roof surfaces 16*r*, 18*r* and the top beams 22*t* of the probes 22.

Vias 28*a*-28*e*, 30*a*-30*e* may be fabricated through the substrate 26 connecting the roof surfaces 16*r*, 18*r* and the ground plane 11, wherein the vias 28*a*-28*e*, 30*a*-30*e* extend approximately perpendicular to the ground plane 11. The vias 28*a*-28*e*, 30*a*-30*e* are preferably fabricated close to the edges of the roof surfaces 16*r*, 18*r*, such as to implement vertical sidewalls 16*a*, 18*a* of the resonator elements 16, 18. The vias 28*a*-28*e*, 30*a*-30*e* may be fabricated by manufacturing through-going holes extending through the substrate 26 at the intended locations for the vias 28*a*-28*e*, 30*a*-30*e*. The through-going holes may be filled with a conductive material to form conductive pillars 28*a*-28*e*, 30*a*-30*e*, the conductive pillars 28*a*-28*e*, 30*a*-30*e* acting as vertical sidewalls of the resonator elements 16, 18.

A probe 22 may be constructed by fabricating a through-going hole extending approximately perpendicularly to the ground plane 11 from the via opening 22*v* to the top beam 22*t*, and by filling the through-going hole with a conductive material to form the feed portion 22*f*. To form the probe tip 22*p* of the probe 22, a metallized portion 22M may be provided inside of the substrate 26, such as close to the interface between the first and second substrate elements 26*a*, 26*b*. A through-going hole extending through the substrate 26 may be formed between the metallized portion 22M and the top beam 22*t*, said through-going hole extending approximately perpendicularly to the ground plane 11. The through-going hole may be filled with a conductive material, such as to form the probe tip 22*p*.

Naturally, all through-going holes may be fabricated in a single processing step or may be fabricated individually for each of the first and second substrate elements 26*a*, 26*b* of the multilayered substrate 26, and the through-going holes may be filled with a conductive material in a subsequent step, such as by metallization of the fabricated through-going holes, to form the vias 28*a*-28*e*, 30*a*-30*e* and the probe 22 at the same time. Hence, the antenna 10 may be fabricated with simple means in a substrate 26.

Figure 4:
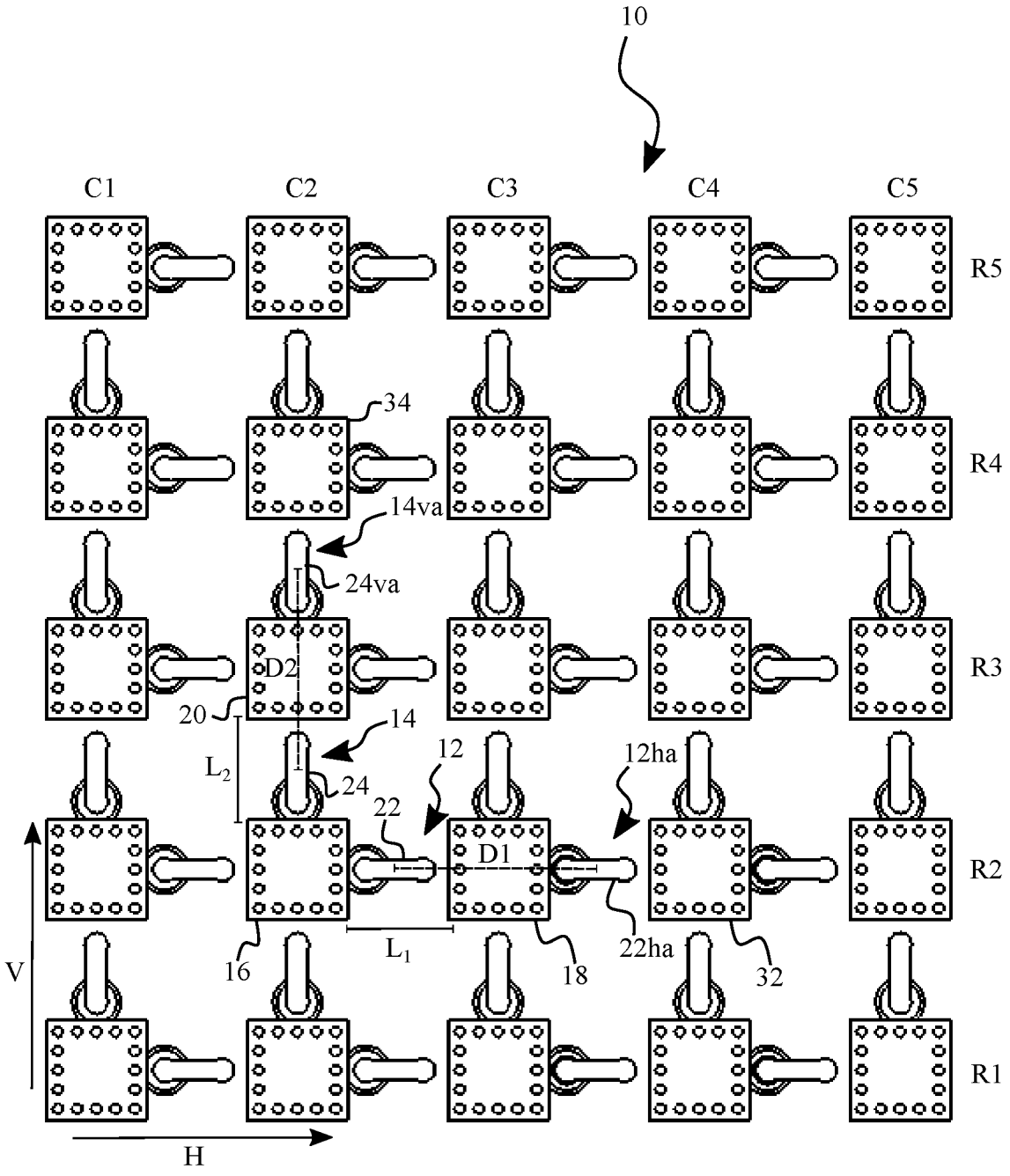
FIG. 4 is a schematic top view of an antenna according to an example.

FIG. 4 shows an example of an antenna 10 in the form of an antenna array 10, comprising a plurality of resonator elements 16, 18, 20, 32, 34 and probes 22, 22*ha*, 24, 24*va* to provide a plurality of antenna elements 12, 12*ha*, 14, 14*va*. The resonator elements are arranged in rows R1-R5 and columns C1-C5. The spacing between adjacent resonator elements 16, 18, 20, 32, 34 in a row R1-R5 and/or a column C1-C5 may be constant along the row R1-R5 or the 3*o* column C1-C5 as shown in the illustrated example, wherein along rows R1-R5 the resonator elements 16, 18, 32 may be spaced by the first distance L1 and along the columns C1-C5 the resonator elements 16, 20, 34 may be spaced by the second distance L2 which can be equal or similar to the first distance L1.

Probes 22, 22*ha*, 24, 24*va* are arranged between adjacent resonator elements 16, 18, 20, 32, 34. In FIG. 4, along each row R1-R5 and along each column C1-05, probes 22, 22*ha*, 24, 24*va* are provided between each pair of adjacent resonator elements 16, 18, 20, 32, 34. In other words, along each row R1-R5 or along each column C1-05, every pair of adjacent resonator elements 16, 18, 20, 32, 34 may form an antenna element 12, 12*ha*, 14, 14*va* with a probe arranged between the pair of adjacent resonator elements 16, 18, 20, 32, 34.

In FIG. 4, along each row R1-R5, the probe 22*ha* of a horizontally adjacent antenna element 12*ha* that is horizontally adjacent to a first antenna element 12 may be similar or identical to a first probe 22 of the first antenna element 12 and may be translated along the horizontal direction H by a distance D1, which may be equal to the distance between centers of resonator elements 16, 18, 32 of rows R1-R5, wherein the first antenna element 12 is arranged along the vertical direction H. However, in some examples, the horizontally adjacent probe 22*ha* may be a mirror image of the first probe 22, which is mirrored with respect to the second resonator element 18, the second resonator element 18 being arranged between the first probe 22 and the horizontally adjacent probe 22*ha*.

Similarly, in FIG. 4, along each column C1-C5, the probe 24*va* of a vertically adjacent antenna element 14*va* that is vertically adjacent to a second antenna element 14 may be similar or identical to a second probe 24 of the second antenna element 14 and may be translated along the vertical direction V by a distance D2, which may be equal to the distance between centers of resonator elements 16, 20, 34 of columns C1-C5, wherein the second antenna element 14 is arranged along the vertical direction V. However, in some examples, the vertically adjacent probe 24*va* may be a mirror image of the second probe 24, which is mirrored with respect to the third resonator element 20, the third resonator element 20 being arranged between the second probe 24 and the vertically adjacent probe 24*va*.

The distances D1, D2 may be smaller than one half of the design wavelength of the antenna 10 in vacuum, such as to improve a beam steering of the antenna 10. In some embodiments, the distances D1, D2 may be smaller than one half of the wavelength corresponding to the highest frequency value of the intended frequency band of the antenna 10 in vacuum, such as to improve a beam steering of the antenna 10 over the whole intended frequency band of the 3*o* antenna 10.

In some examples, probes 16, 18, 20, 32, 34 arranged in an outer row R5 or an outer column C5 may be not connected to a feed line but may be terminated, such as 50Ω terminated, to improve an antenna characteristic related to the symmetry of the antenna array 10.

Figure 5A:
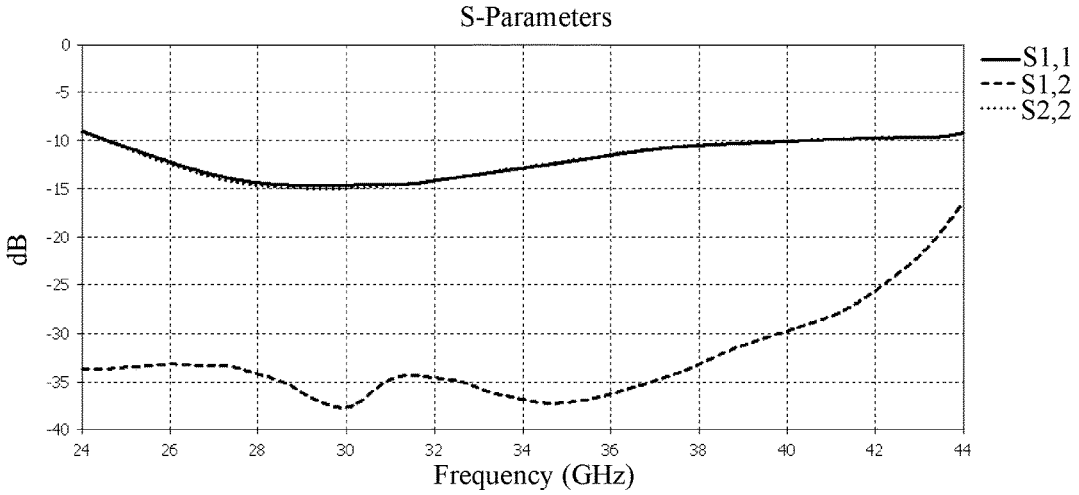
FIG. 5A illustrates a set of S-Parameters for an antenna according to an example.
Figure 5B:
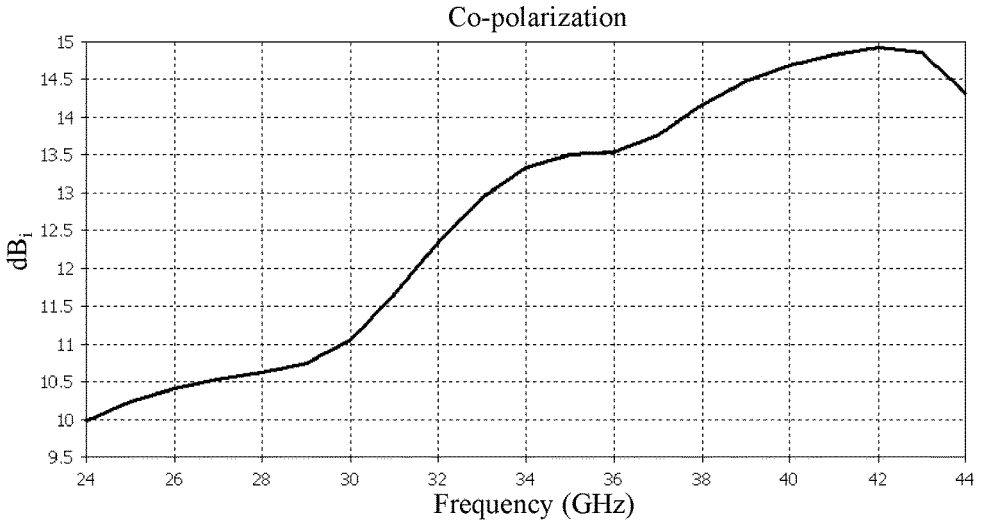
FIG. 5B illustrates simulated values of a co-polarization of an antenna according to an example.
Figure 5C:
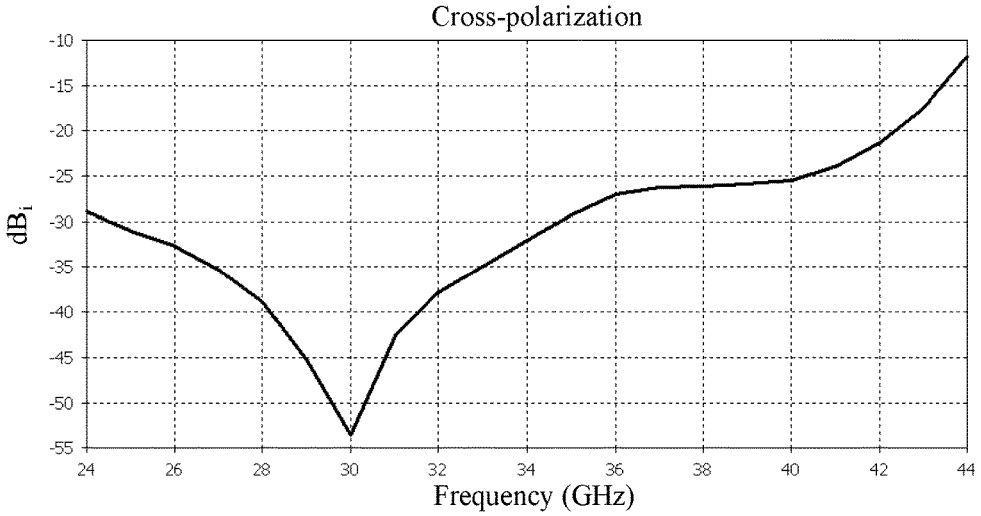
FIG. 5C illustrates simulated values of a cross-polarization of an antenna according to an example.

FIGS. 5A-5C illustrates simulated antenna characteristics as a function of frequency for an antenna 10 according to an example, the antenna 10 comprising a 4×4 array of pairs of first and second antenna elements 12, 14 arranged in rows and columns, such as the ones shown in FIG. 4.

FIG. 5A shows S-parameters S1,1, S1,2, and S2,2 of the antenna 10 as a function of frequency within the frequency band between 24 GHz and 44 GHz. S1,1 relates to the reflected power reflected from all antenna elements 12, 12*ha* oriented along the horizontal direction H, when a signal with the respective frequency is fed into the probes 22, 22*ha* of the antenna elements 12, 12*ha* arranged in the rows R1-R5. S2,2 relates to the reflected power reflected from all antenna elements 14, 14*va* oriented along the vertical direction V, when a signal with the respective frequency is fed into the probes 24, 24*va* of the antenna elements 14, 14*va* arranged in the columns C1-C5. S1,2 relates to the power received by the antenna elements 14, 14*va* arranged in the columns C1-C5 when a signal is fed into the probes 22, 22*ha* of the antenna elements 12, 12*ha* arranged in the rows R1-R5.

The curves relating to S1,1 and S2,2 are almost identical and hence overlying each other in FIG. 5A. Both curves show a reflected power below −9 dB within the investigated frequency band. The antenna may therefore be used to generate electromagnetic radiation over the full frequency band between 24 GHz and 44 GHz. The coupling of power from antenna elements 12, 12*ha* oriented along the horizontal direction H to antenna elements 14, 14*va* oriented along the vertical direction V given by the value of S1,2 is low within the investigated frequency band, wherein S1,2 is below −17 dB over the entire curve.

FIG. 5B illustrates the simulated co-polarization of the same antenna 10 as in FIG. 5A also comprising a 4×4 antenna array in terms of $dB_i$ (effective isotropic radiated power) as a function of frequency in the investigated frequency band. To obtain the co-polarization, first the received horizontally polarized electromagnetic power can be determined which is received by a horizontally polarized receiver facing the antenna 10 when the antenna elements 12, 12*ha* oriented along the horizontal direction H are fed with a signal at the respective frequency and with the same phase. The received horizontally polarized electromagnetic power may then be divided by the signal received by the same receiver from an isotropic source placed at the site of the antenna 10 and radiating the same power to obtain the effective isotropic radiated power having horizontal polarization.

FIG. 5C illustrates the simulated cross-polarization of the same antenna 10 as in FIGS. 5A and 5B also comprising a 4×4 antenna array in terms of $dB_i$ (effective isotropic radiated power) as a function of the frequency in the investigated frequency band. To obtain the cross-polarization, first the received transversely polarized electromagnetic power can be determined which is received by a vertically polarized receiver facing the antenna 10 when the antenna elements 12, 12*ha* oriented along the horizontal direction H are fed with a signal at the respective frequency and with the same phase. The received transversely polarized electromagnetic power may then be again divided by the signal received by the same receiver from an isotropic source placed at the site of the antenna to and radiating the same power to obtain the effective isotropic radiated power having vertical (transverse) polarization.

As can be discerned from FIGS. 5A and 5C, a low amount of vertically polarized radiation may be emitted by horizontally arranged antenna elements 12, 12*ha* of the antenna 10, the vertically (transversely) polarized radiation being attenuated by at least −20 dB with respect to the horizontally polarized radiation, such that the output of the antenna 10 can be highly polarized, allowing dual polarized operation of the antenna 10.

As can be seen from the values of the co-polarization in FIG. 5B, the directionality of the antenna can be increased by beam steering, such that the antenna 10 can provide an effective gain above 10 dB.

The description of the preferred embodiments and the figures merely serves to illustrate the invention and the beneficial effects associated therewith, but should not be understood to imply any limitation. The scope of the invention is to be determined solely by the appended claims.

LIST OF REFERENCE SIGNS

10 antenna/antenna array
11 ground plane
12, 12*ha* horizontal/first antenna elements
14, 14*va* vertical/second antenna elements
16 first resonator element
18 second resonator element
16*a, b, c, d* sidewalls of the first resonator element
18*a* sidewall of the second resonator element
20*a* sidewall of the third resonator element
16*r*, 18*r*, 20*r* roof surfaces of the first/second/third resonator elements
20 third resonator element
22-25 probes adjacent to the first antenna element
22, 22*ha* horizontal/first probe
22*f* feed portion of a gamma-shaped probe
22*t* top beam of a gamma-shaped probe
22*p* probe tip of a gamma-shaped probe
22M metallized tip portion of a gamma-shaped probe
22V-25V via openings for the probes
24, 24*va* vertical/second probe
26 (multilayered) substrate
26*a*, 26*b* substrate elements
27 bonding layer
28*a*-28*e* vias of the first resonator element
30*a*-30*e* vias of the second resonator element
32 fourth resonator element
34 fifth resonator element
H horizontal direction
V vertical direction
L1-L7 lateral dimensions in the antenna
H1-H3 heights in the antenna
$cl_1$, $cl_2$ connecting line between the first and second/third resonator elements
R1-R5 rows of an antenna array
C1-C5 columns of an antenna array
D1, D2 distance between horizontally/vertically adjacent probes

What is claimed is:

1. An antenna comprising:

a ground plane, wherein the ground plane is arranged on a substrate a first antenna element arranged for one or both of emitting and receiving electromagnetic radiation with a first polarization direction at a design wavelength, the first antenna element comprising:

a first probe, the first probe extending through the ground plane and being electrically isolated from the ground plane, and a first resonator, the first resonator comprising a first resonator element and a second resonator element, the first resonator element and the second resonator element each being coupled to the ground plane and each having a vertical sidewall facing the first probe, the vertical sidewall being approximately perpendicular to the ground plane, wherein the vertical sidewalls of the first and second resonator elements, which are facing the first probe, are spaced by a first distance along a first direction and form a first cavity, wherein the first probe is arranged at least partially in the first cavity between the first resonator element and the second resonator element, and a second antenna element arranged for one or both of emitting and receiving electromagnetic radiation with a second polarization direction at the design wavelength, the second polarization direction being different from the first polarization direction, the second antenna element comprising:

a second probe, the second probe extending through the ground plane and being electrically isolated from the ground plane, and a second resonator, the second resonator comprising the first resonator element and a third resonator element coupled to the ground plane, the first and third resonator elements each having a vertical sidewall facing the second probe, the vertical sidewall being approximately perpendicular to the ground plane, wherein the vertical sidewalls of the first and third resonator elements, which are facing the second probe, are spaced by a second distance along a second direction and form a cavity, the second direction being different from the first direction, wherein the second probe is arranged at least partially in the second cavity between the first resonator element and the third resonator element;

wherein one or more of the first, the second, and the third resonator element comprise a metallic patch on a surface of the substrate, said surface being spaced from the ground plane by one quarter of the design wavelength, wherein the vertical sidewall of one or more of the first, the second and the third resonator element is formed by a plurality of vias extending through the substrate, the vias being approximately perpendicular to the ground plane and connecting the metallic patch to the ground plane, wherein adjacent vias are spaced by less than one eighth of the design wavelength.

2. The antenna of claim 1, wherein the first probe, the first resonator element and the second resonator element are arranged with the ground plane such as to implement a shorted quarter-wave patch antenna.

3. The antenna of claim 2, wherein a height of one or both of the first resonator element and the second resonator element is chosen such that the height corresponds to a quarter of the design wavelength.

4. The antenna of claim 1, wherein the first probe extends along the first direction in the first cavity.

5. The antenna of claim 1, wherein each of the vertical sidewalls of the first and second resonator elements facing the first probe is approximately perpendicular to the first direction.

6. The antenna claim 1, wherein one or both of the first and the second probe is coupled to a feed line and comprises a gamma-shaped probe section, the gamma-shaped probe section comprising:

a feed portion extending through the ground plane and coupling the gamma-shaped probe section and the feed line, a top beam, the top beam being arranged approximately parallel to the first or second direction of the first or second cavity, and a probe tip, the probe tip being connected to the top beam and extending towards the ground plane, wherein the top beam connects the feed portion and the probe tip.

7. The antenna claim 1, wherein one or more of the first, the second and the third resonator element comprises a roof surface, the roof surface extending parallel to ground plane and being spaced from the ground plane by a roof distance.

8. The antenna of claim 7, wherein said roof distance of one or both of the first resonator element and the second resonator element is selected such that the roof distance corresponds to a quarter of the design wavelength.

9. The antenna of claim 1, wherein the vias form an outer wall surrounding a confined space of one or both of the first and the second resonator element, the confined space being defined by a roof surface of the resonator element and the vias.

10. The antenna of claim 1, wherein the antenna comprises a plurality of resonator elements, the resonator elements being arranged in rows and columns along the first and second directions respectively.

11. The antenna of claim 1, further comprising a third antenna element, the third antenna element comprising a third probe, the third probe extending through the ground plane and being electrically isolated from the ground plane, and a third resonator, the third resonator comprising a fourth resonator element and the second resonator element, the fourth resonator element and the second resonator element each being coupled to the ground plane and each having a vertical sidewall, the vertical sidewall being approximately perpendicular to the ground plane, wherein the vertical sidewalls of the second and fourth resonator elements, which are facing the third probe, are spaced by the first distance along the first direction and form a third cavity, wherein the third probe is arranged at least partially between the fourth resonator element and the second resonator element, wherein the third antenna element is arranged for one or both of emitting and receiving electromagnetic radiation along the first polarization direction at the design wavelength, wherein the third probe is arranged at least partially in the third cavity between the second resonator element and the fourth resonator element.

12. The antenna of claim 11, wherein the first probe and the third probe are spaced by a distance, which is smaller than one half of the wavelength of the highest frequency of an intended frequency band of the antenna in vacuum.

13. The antenna of claim 1, wherein the second probe extends along the second direction in the second cavity.

14. The antenna of claim 1, wherein each of the vertical sidewalls of the first and third resonator elements facing the second probe is approximately perpendicular to the second direction.

15. The antenna of claim 1, wherein the first probe, the first resonator element and the second resonator element are arranged with the ground plane such as to implement a shorted quarter-wave patch antenna, wherein a height of one or both of the first resonator element and the second resonator element is chosen such that the height corresponds to a quarter of the design wavelength, wherein the first probe extends along the first direction in the first cavity, and the second probe extends along the second direction in the second cavity.

16. The antenna of claim 1, wherein each of the vertical sidewalls of the first and second resonator elements facing the first probe is approximately perpendicular to the first direction and each of the vertical sidewalls of the first and third resonator elements facing the second probe is approximately perpendicular to the second direction.

17. The antenna of claim 16, wherein one or both of the first and the second probe is coupled to a feed line and comprises a gamma-shaped probe section, the gamma-shaped probe section comprising:

a feed portion extending through the ground plane and coupling the gamma-shaped probe section and the feed line, a top beam, the top beam being arranged approximately parallel to the first or second direction of the first or second cavity, and a probe tip, the probe tip being connected to the top beam and extending towards the ground plane, wherein the top beam connects the feed portion and the probe tip.

18. A method for manufacturing an antenna comprising:

providing a substrate with a ground plane, manufacturing a first antenna element arranged for and/or receiving electromagnetic radiation with a first polarization direction at a design wavelength, wherein manufacturing the first antenna element comprises:

arranging a first probe, the first probe extending through the ground plane and being electrically isolated from the ground plane, and manufacturing a first resonator, the first resonator comprising a first resonator element and a second resonator element, the first resonator element and the second resonator element each being coupled to the ground plane and each having a vertical sidewall facing the first probe, the vertical sidewall being approximately perpendicular to the ground plane, wherein the vertical sidewalls of the first and second resonator elements, which are facing the first probe, are spaced by a first distance along a first direction and form a first cavity, wherein the first probe is arranged at least partially in the first cavity between the first resonator element and the second resonator element, and manufacturing a second antenna element arranged for one or both of emitting and receiving electromagnetic radiation with a second polarization direction at the design wavelength, the second polarization direction being different from the first polarization direction, wherein manufacturing the second antenna element comprises:

arranging a second probe, the second probe extending through the ground plane and being electrically isolated from the ground plane, and manufacturing a second resonator, the second resonator comprising the first resonator element and a third resonator element coupled to the ground plane, the first and third resonator elements each having a vertical sidewall facing the second probe, the vertical sidewall being approximately perpendicular to the ground plane, wherein the vertical sidewalls of the first and third resonator elements, which are facing the second probe, are spaced by a second distance along a second direction and form a cavity, the second direction being different from the first direction, wherein the second probe is arranged at least partially in the second cavity between the first resonator element and the third resonator element wherein manufacturing one or more of the first, the second and the third resonator elements comprises:

arranging a metallic patch on a surface of the substrate, said surface being spaced from the ground plane by one quarter of the design wavelength, and connecting the metallic patch with metallic vias to the ground plane, said vias extending through the substrate, such that the metallic vias form vertical sidewalls of the respective resonator element, wherein adjacent vias are spaced by less than one eighth of the design wavelength.

19. The method of claim 18, comprising manufacturing a plurality of resonator elements arranged in rows and columns along the first and second directions respectively, and arranging two probes on opposite sides of a common resonator element of the plurality of resonator elements, wherein the two probes are spaced by less than one half of the wavelength of the highest frequency of an intended frequency band of the antenna in vacuum along one or both of the first direction and the second direction.

20. The method of claim 18, wherein arranging one or both of the first and second probes comprises forming a gamma-shaped probe, the forming of the gamma-shaped probe comprising:

arranging a metallic strip on the substrate, the metallic strip being arranged between adjacent metallic patches of one or more of the first, second and third resonator elements, such that the metallic strip is one or both of aligned with and close to a connecting line connecting the centers of the adjacent metallic patches, wherein a distance between the metallic strips and the ground plane is equal to or smaller than a distance between the metallic patches and the ground plane, forming a feeding via at a first end of each metallic strip, the feeding via extending through the substrate and the ground plane, and forming a tip via at a second end of each metallic strip, the second end being opposite the first end, wherein the tip via protrudes into the substrate and does not extend through the ground plane.

* * * * *